US005333729A

United States Patent [19]

Wolfe

[11] Patent Number: 5,333,729

[45] Date of Patent: Aug. 2, 1994

[54] PACKAGED CIGARETTES

[75] Inventor: Patricia K. Wolfe, Colfax, N.C.

[73] Assignee: R. J. Reynolds Tobacco Company, Winston-Salem, N.C.

[21] Appl. No.: 945,315

[22] Filed: Sep. 14, 1992

[51] Int. Cl.[5] ..... B65D 85/10

[52] U.S. Cl. ..... 206/268; 206/271; 206/273

[58] Field of Search ..... 206/265-271, 206/273, 274; 229/211, 223, 232, 233, 245, 247

[56] References Cited

U.S. PATENT DOCUMENTS

| | | | |
|---|---|---|---|
| Re. 26,712 | 11/1969 | Whitaker et al. . | |
| 1,877,955 | 9/1932 | Ottinger | 206/273 |
| 1,951,343 | 3/1934 | Butt et al. . | |
| 1,957,777 | 5/1934 | Heath | 206/268 |
| 2,107,826 | 2/1938 | Keller | 206/268 |
| 2,109,100 | 2/1938 | Brophy | 206/268 |
| 2,355,250 | 8/1944 | Voss . | |
| 2,383,728 | 8/1945 | Little . | |
| 2,404,312 | 7/1946 | Reynolds | 206/268 |
| 2,489,452 | 11/1949 | Davis . | |
| 2,704,182 | 3/1955 | Sandler . | |
| 2,910,175 | 10/1959 | Williams . | |
| 2,960,264 | 11/1960 | Walter . | |
| 3,052,398 | 9/1962 | Benjamin | 206/268 |
| 3,270,945 | 9/1966 | Whitaker et al. | 206/268 |
| 3,695,422 | 10/1972 | Tripodi . | |
| 4,375,260 | 2/1983 | Focke et al. . | |
| 4,717,017 | 1/1988 | Sprinkel, Jr. et al. . | |
| 5,139,140 | 8/1992 | Burrows et al. . | |

FOREIGN PATENT DOCUMENTS

| | | | |
|---|---|---|---|
| 454003 | 10/1991 | . | |
| 1043930 | 11/1958 | Fed. Rep. of Germany | 206/273 |

*Primary Examiner*—Jimmy G. Foster

[57] ABSTRACT

A soft package containing cigarettes and a sealing film. The package includes a top closure tab which acts to re-close the package once the package is opened. Pressure sensitive adhesive can be applied to the top closure tab in order that the closure tab can act to reseal the opened package to some degree.

7 Claims, 6 Drawing Sheets

PACKAGED CIGARETTES

BACKGROUND OF THE INVENTION

The present invention relates to smoking articles such as cigarettes, and in particular, to the manner in which cigarettes are packaged.

Popular smoking articles, such as cigarettes, have a substantially cylindrical rod shaped structure and include a charge of smokable material such as shredded tobacco (e.g., cut filler) surrounded by a paper wrapper thereby forming a so-called "tobacco rod". It has become desirable to manufacture cigarettes having cylindrical filter elements aligned in an end-to-end relationship with the tobacco rod. Typically, filter elements are manufactured from fibrous materials (e.g., cellulose acetate tow) circumscribed by plug wrap, and are attached to the tobacco rods using circumscribing tipping materials. Such cigarettes having filter elements are referred to as "filter cigarettes".

Filter cigarettes conventionally have been sold in packages, and each package normally contains 20 or 25 cigarettes. Typical cigarette packages have a generally rectangular parallelepiped form. One type of popular cigarette package employs a container having the form of a so-called "soft package" or "soft pack". See, for example, U.S. Pat. Nos. 2,383,728 to Little; 3,695,422 to Tripodi and 4,717,017 to Sprinkel, Jr., et al.; and U.S. patent application Ser. No. 760,046, filed Sep. 13, 1991. Cigarettes are removed from a soft package by tearing away a portion of the top of the package, in order that cigarettes can be easily accessed from the top of the package.

Such cigarette containers typically are overwrapped using a clear polymeric film (e.g., polyethylene or polypropylene overwrap films) or a metallized thermoplastic film, to maintain freshness of the cigarettes within the container, and thereby form a final cigarette package. A strip of polymeric material known as a "tear tape" is provided for easy opening of the polymeric overwrap films. The tear tape is positioned adjacent to the top of the package. The tear tape (which normally has some color and projects slightly from the package as a tab) is pulled by the smoker to easily open the polymeric overwrap. In particular, the protruding end of the tear tape is pulled to slit the polymeric overwrap, the polymeric overwrap covering the top of the container is removed, and the top of the container is opened to expose the filter ends of the cigarettes contained therein. The smoker then grasps the filter end of a cigarette with his/her fingers to remove the cigarette from the package.

Soft packages, once opened, are not easily re-closed. That is, unlike the type of cigarette package described in U.S. Pat. No. 5,390,340 to Burrows et al., a top portion of the soft package often is torn away in a manner such that the soft package cannot be re-closed very effectively or with any great degree of ease. As a result, once the package is opened, cigarettes can have a tendency to fall out of the package, and foreign materials can have an undesirable tendency to be introduced into the package. In addition, certain popular soft package designs can employ significant amounts of packaging materials.

It would be desirable to provide packaged cigarettes such that the package can be readily opened, cigarettes can be readily removed from the package, and the package can be easily re-closed.

SUMMARY OF THE INVENTION

The present invention relates to a package containing cigarettes. The package includes a container for cigarettes, and the container has a "soft package" configuration. Normally, the soft package includes an outer paper label wrap and an inner metal foil/paper laminate wrap.

The package includes a top tab or closure member. The top closure member can include an adhesive or be otherwise configured, in order to maintain that closure member sealed to the package. As such, the package can be opened and re-closed. The closure member can be applied to the package by the manufacturer, or by the smoker. The closure member also can be removable from the package. A separate pressure sensitive adhesive also can be applied to the closure member to maintain that member in a closed position in order to (ii) re-close an opened package, and (ii) re-seal an opened package to some degree. The top closure member typically is manufactured from a flexible sheet-like material, such as a metallized thermoplastic, a thermoplastic, a paper/metal foil laminate, a paperboard material or a thermoplastic/paperboard laminate material.

The package most preferably includes a sealing film, such as a clear, colorless thermoplastic film, which circumscribes the cigarette container. The sealing film also can be a metallized thermoplastic film. A tear tape, or other suitable film slitting means, is interposed between the cigarette container and the sealing film. Normally, the tear tape is identified by a color so as to be in contrast with the sealing film and container, and one end of the tear tape protrudes from the sealing film as a tab such that it can be grasped conveniently by the smoker. Typically, the tear tape is located adjacent to the top of the cigarette container.

In one preferred embodiment, the package includes an inner container (e.g., a paper wrap) and an outer sealing film (e.g., a metallized thermoplastic film). The inner container contains cigarettes and includes a closure stamp tab over a portion of the top thereof. The sealing film surrounds the inner container and the top of the package. The sealing film has a region of weakness (e.g., a scored region, a series of cuts or perforation line) in the region thereof which overlies the closure stamp tab. A top tab overlies at least a portion of the top of the sealing film, and particularly that region of weakness in the sealing film. The top tab is adhered to the top of the package. As such, when the top tab is pulled, a portion of the sealing film at the top of the package is torn away to open the package and expose cigarettes within the package. The top tab then can be used as a closure member to re-close the package, or the top tab can be torn away from the package. Such a package does not require a tear tape to open that package.

Cigarettes packaged according to the present invention can be placed in cartons, tax marked as is known in the art, and sold commercially. The present invention provides a smoker with a convenient manner for opening a package of cigarettes and removing cigarettes positioned within the container from the package, and then re-closing the container.

DETAILED DESCRIPTION OF THE PREFERRED EMBODIMENTS

Figure 1:
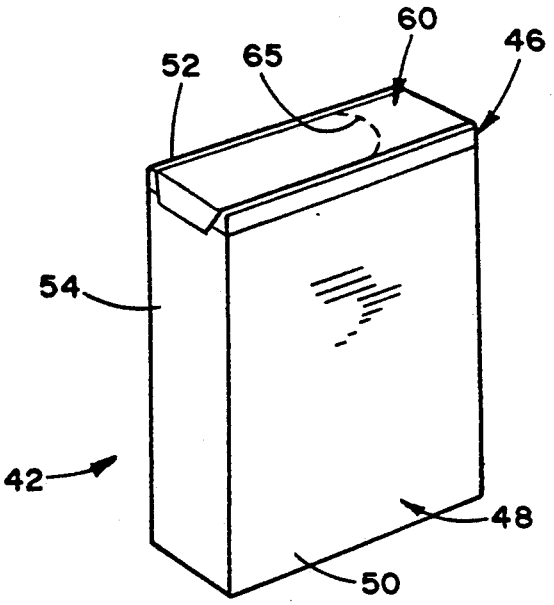
FIG. 1 is a perspective of a cigarette package having a closure member, the package being shown in a closed position.

Referring to FIG. 1, one type of cigarette package 42 includes soft container, which typically is manufactured from an inner wrap 46 and an outer label wrap 48. An example of a preferred inner wrap 46 is a metal foil/paper laminate, such as aluminum foil adhered to 28 pound bond paper. The outer label wrap 48 typically is a paper material, such as a clay coated 44 pound litho sheet, and includes printed indicia (e.g., graphics, brand identification, etc.), so as to clearly set forth the front, back, top and bottom of the package. Representative cigarette packages are employed commercially, and the design and manufacture of such types of packages will be readily apparent to the skilled artisan. A representative container shown in FIG. 1 includes a front wall 50, a top wall 52 and a side wall 54. The bottom wall, back wall, and side wall opposite side wall 54 are not shown in FIG. 1. The front, back and side walls extend upward from the bottom wall. Typical packages have widths of about 52 mm to about 55 mm; depths of about 21 mm to about 24 mm; and heights of either about 86 mm to about 90 mm or about 101 mm to about 104 mm.

The soft container 44 normally is constructed so that the paper side of the inner wrap laminate 46 faces the inside of the container, and the inner wrap is folded so as to contain the cigarettes therein. Most preferably, the inner wrap is sealed shut, and maintained in a secured closed position by applying heat seal or coating adhesive in a pattern on the inner wrap laminate such that, when folded, the inner wrap remains sealed shut. Manners and methods for sealing the inner wrap shut will be apparent to the skilled artisan. The outer label wrap 48 normally is folded so as to fit over the front, back, bottom and the two sides of the inner wrap. In particular, the outer label wrap substantially covers each wall of the inner wrap except for the top. Normally, an adhesive is applied to the outer label wrap at the inner bottom and at least one inner side of the container to hold the wrap in place relative to the inner wrap. Closure tab 60 is positioned over the top of the container, and is adhered to the side walls of the container near the top of that container. A perforated region or line 65 extends across the width of the closure tab 60.

Figure 2:
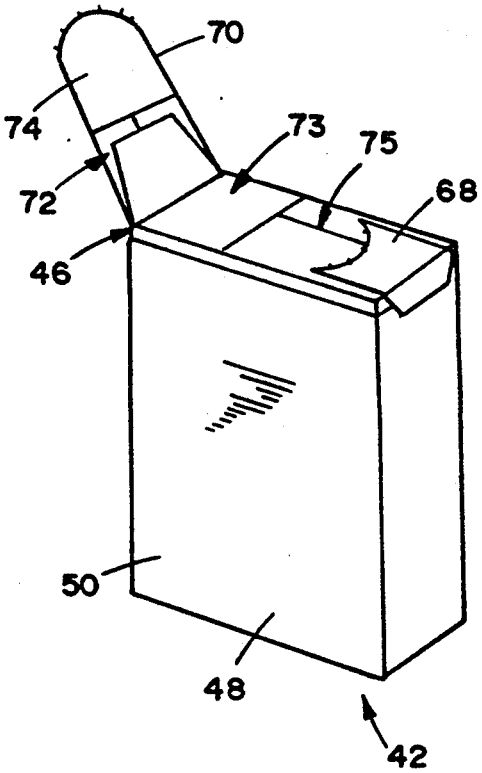
FIG. 2 is a perspective of the package of FIG. 1 in an open position.

Referring to FIG. 2, the cigarette package 42 of FIG. 1 is shown in an open position. In particular, the perforated region 65 of the closure tab is broken so as to break that tab in two. The closure tab includes a portion 68 which adheres to the top of the container and remains stationary with the container. The closure tab also includes a portion 70 which adheres to a portion of the innerliner 72 but is movable relative to the container so as to expose an open region 73 and cigarettes (not shown) within the package. The movable closure tab portion 70 includes a separable pressure sensitive adhesive in region 74 thereof which overlies top region 75 of the container so as to provide good closure of that tab while allowing that tab to be moved for reopening the container. Separable pressure sensitive adhesive, or a more permanent pressure sensitive adhesive, is applied to the remaining length of the closure tab in order to maintain contact of those other portions of the closure tab with the remaining top and side regions of the package.

The package shown in FIG. 1 includes a clear, colorless, outer sealing film (not shown), such as an 80 gauge polypropylene film, or the like. The film is folded and sealed so as to circumscribe the soft container 44. A tear tape (not shown) for slitting the sealing film is interposed between the cigarette container and the sealing film, in a region adjacent to the top wall 52 of the container and encircles the container (i.e., the tear tape extends around the front wall, back wall and side walls of the container adjacent to the top wall). Methods for sealing packages using sealing films (e.g., equipment and suitable adhesives) will be apparent to the skilled artisan. One end of the tear tape protrudes from the sealing film and acts as a tab for the smoker to grasp. Other suitable sealing films are set forth in European Patent Application No. 454,003 and in U.S. patent application Ser. No. 806,964, filed Dec. 12, 1991, which are incorporated herein by reference. Representative sealing films currently are employed on commercially available brands, and such sealing films will be apparent to the skilled artisan. See, also, U.S. Pat. No. 4,807,745 to Langley, et al. and U.S. patent application Ser. No. 760,046 filed Sep. 13, 1991.

Normally, the closure tab 60 is applied to the remainder of the package by the manufacturer prior to the time that the package is sealed with the sealing film. As such, the sealing film is removed from the top of the package by the smoker, and then the remainder of the package is opened using the closure tab. Alternatively, the package can be sealed with sealing film without the closure tab attached to the package, and the smoker can apply the closure tab to the package after the sealing film is removed from the top of the package.

The container 44 contains a plurality of cigarettes. Typically, twenty filter cigarettes are positioned in a 7-6-7 or 7-7-6 configuration within the container. The filter ends of the cigarettes normally are positioned at the top of the container (i.e., at the end of the container near the tear tape). As such, when the smoker pulls the tear tape to slit the sealing film, removes the sealing film from the top of the package, breaks the closure tab which has been applied to the top of the package by the manufacturer, and tears open the top wall of the package, the smoker views the filter ends of the cigarettes within the container.

Figure 3:
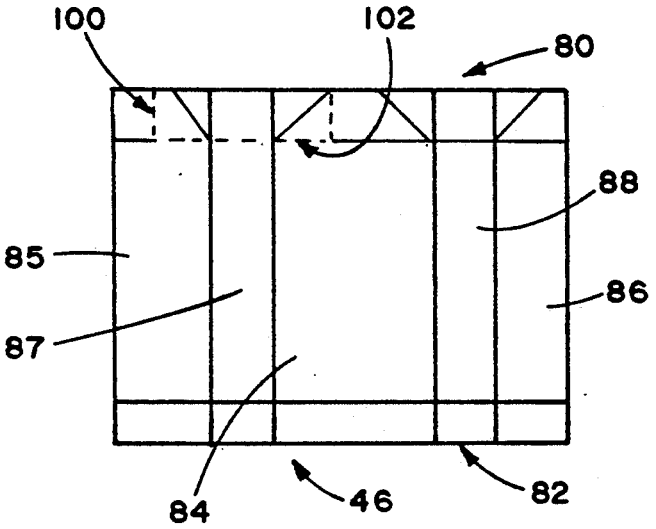
FIG. 3 is a top plan view of an unassembled innerliner for the package of FIG. 1.

Referring to FIG. 3, there is shown inner wrap 46 for the package shown in FIG. 1 shown in an open position. The inner wrap or innerliner is shown to have panels or regions which correspond to the top 80, bottom 82, front 84, back 85, 86 and both sides 87, 88 of the ultimate container which is assembled from the innerliner. The innerliner is shown to have fold lines, as well as at least one cut or perforated region 100 (shown as dotted lines) near the top of the innerliner. The cuts or perforations are provided in order that the package incorporating the assembled sealed innerliner can be opened readily.

Figure 4:
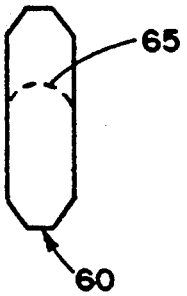
FIG. 4 is a top plan view of a closure tab for the package of FIG. 1.

Referring to FIG. 4, there is shown a closure tab 60. The closure tab has a width which approximates that of the depth of the ultimate package to which the closure tab is applied, and a length which is slightly greater than the width of the package to which the closure tab is applied. A representative closure tab has a length of about 70 mm to about 75 mm, and a width of about 20 mm to about 21 mm. The closure tab includes a perforated region 65 across the width thereof in order that the closure tab can be torn in two after that closure tab is applied to the package.

Figure 5:
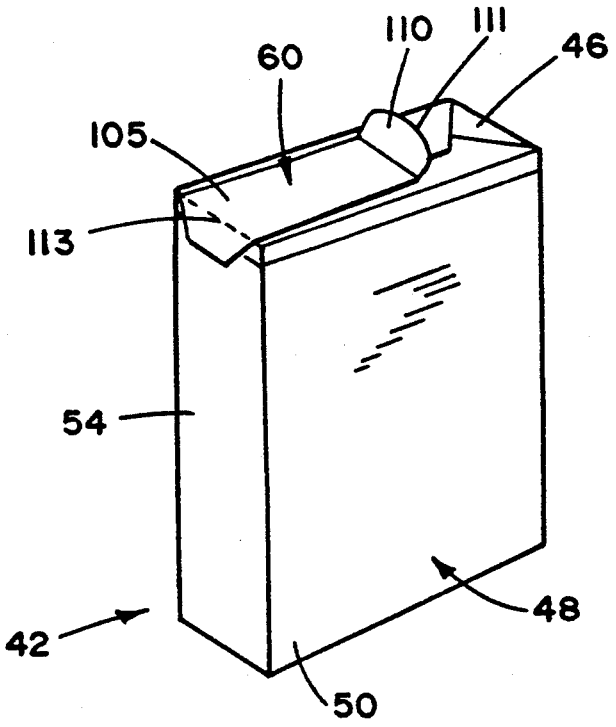
FIG. 5 is a perspective of a cigarette package having a closure member, the package being shown in a closed position.

Referring to FIG. 5, there is shown a cigarette package essentially as shown in FIG. 1. However, the closure tab 60 is not perforated in region 105 thereof which overlies the top of the package, and usually does not extend over the complete width of the top of the package. Rather, one end of the closure tab is adhered to one side wall of the container near the top of that container. The tab also is adhered to the top of the container over the region of the innerliner which is adapted to be torn away as well as an adjacent portion of the innerliner. However, end region 110 of the closure tab 60 does not have adhesive supplied thereto, in order that the end 111 of the tab can be grasped readily by the smoker to pull the tab back (i.e., away from the top of the package). The closure tab 60 also is perforated 113 in the region thereof (i.e., line) which overlies the top side edge of the package. The line of perforation 113 acts as a hinge to allow the tab to be readily opened and closed, and also allows for the top portion of the tab to be torn from the package once the package is opened.

Figure 6:
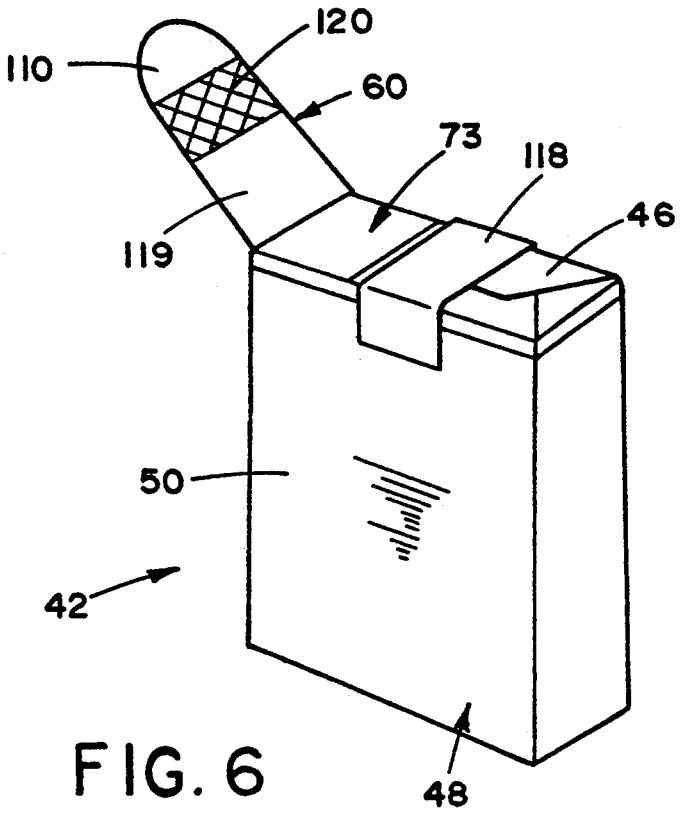
FIG. 6 is a perspective of a cigarette package having a closure member and a closure stamp, the package being shown in a closed position.

Referring to FIG. 6, there is shown a cigarette package essentially as shown in FIG. 5. However, the inner wrap 46 is not necessarily sealed shut at the top of the package. Rather, the inner wrap 46 is folded shut as is conventional when packaging cigarettes in a soft package. The inner wrap 46 can be of the type previously described with reference to FIG. 3, or of a conventional type and configuration. As such, the closure tab 60 can be pulled from the top of the package and into an open position. The inner wrap 46 then can be opened and torn away to expose cigarettes (not shown) in the package, as is conventional when a soft package is opened by a smoker. The package includes a closure stamp 118 over the top of the container, and is adhered to the top regions of the front and back walls of the outer label wrap 48, as well as to the label wrap 48 at the top of the package. Representative closure stamps and the selection thereof will be apparent to the skilled artisan. The closure tab then can be used to re-close the opened package. Normally, no adhesive is applied to the inner face of the closure tab in that region 119, which overlies the opened portion 73 of the package, but a separable pressure sensitive adhesive is applied to that region 120 (shown as shaded) which overlies the remaining top portion of the opened package. The closure tab 60 also includes end region 110 for the smoker to grasp without having to touch an adhesively coated portion of the tab.

A representative closure tab of the type described with reference to FIGS. 5 and 6 has a width of about 20.5 mm and a total length of about 44 mm. The end region 110 extends over a length of about 7 mm, the perforation line 113 is positioned about 7 mm from the opposite end of the closure tab, and the region 120 having adhesive applied extends across the closure tab over a length of about 11 mm.

Figure 7:
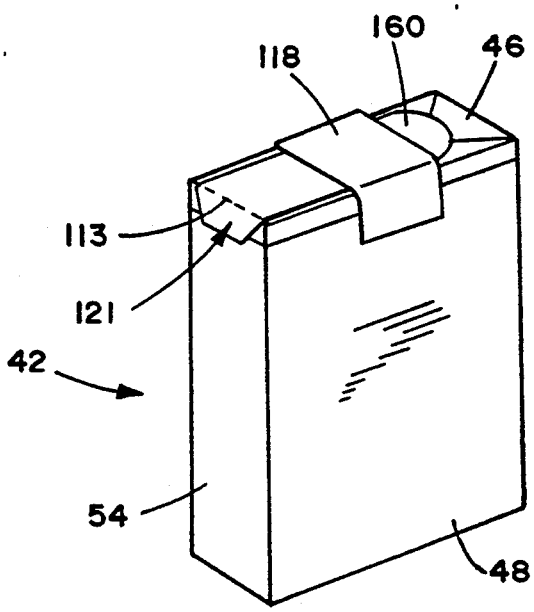
FIG. 7 is a perspective of a cigarette package having a closure member and a closure stamp, the package being shown in a closed position.

Referring to FIG. 7, there is shown a cigarette package essentially as shown in FIG. 6. However, the closure tab 60 is adhered only to one side wall of the container in region 121 near the top of that container, and on the corresponding side wall at the other side of the container. The remaining portion of the closure tab which is adapted to overlie the top of the package, most preferably is not adhered to the top of the package. Rather, the closure tab is adapted to underlie the closure stamp 118 which extends across the top of the package but is not adhered to the label wrap 46 at the top of the package. Hence, the closure tab can be positioned so as to maintain the package in a closed position, or the closure tab can be removed from under the closure stamp to open the package.

Figure 8:
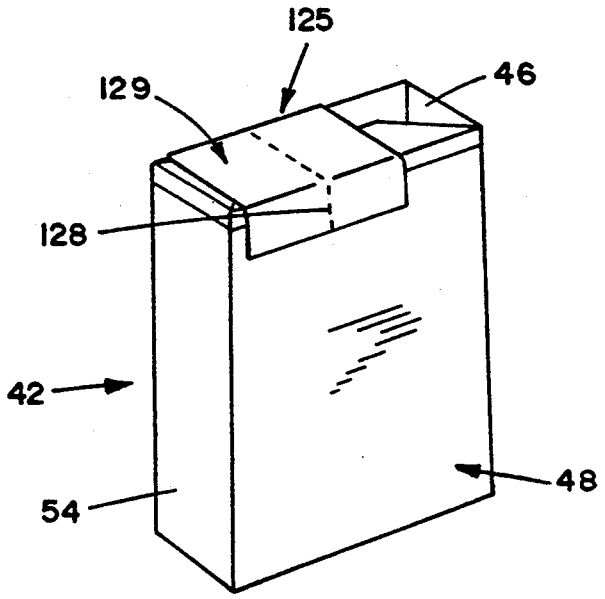
FIG. 8 is a perspective of a cigarette package having a closure member, the package being shown in a closed position.

Referring to FIG. 8, there is shown a cigarette package essentially as shown in FIG. 1. However, enlarged closure tab 125 is positioned to cover the top of the container at one side of the container and not cover the top of the container at the other side of the container. However, if desired, the enlarged closure tab can extend across the top of the container. The closure tab also covers, and is adhered to, the front and back walls of the label wrap 48 near the top of that container. The closure tab 125 also includes a perforated line 128 across that tab extending from the front of the package toward the back of the package. As such, portion 129 of the tab 120 can be lifted so as to expose the top of the package, and pressed against the top front wall of the label wrap of the package in order that the package can be reclosed. Typically, separable pressure sensitive adhesive is applied to the inner face of the closure tab in portion 129, while a more permanent pressure sensitive adhesive is applied to the remaining inner face of the closure tab on the opposite side of the perforated line 128.

Figure 9:
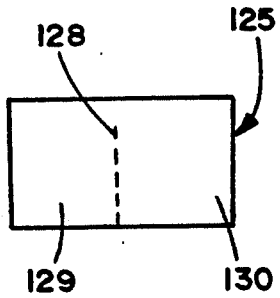
FIG. 9 is a top plan view of a closure tab for the package of FIG. 8.

Referring to FIG. 9, there is shown a top plan view of the closure tab 125 of the package described with reference to FIG. 8. There it is shown that the perforation line 128 extends to what corresponds to the top of the back wall or face of the package.

Figure 10:
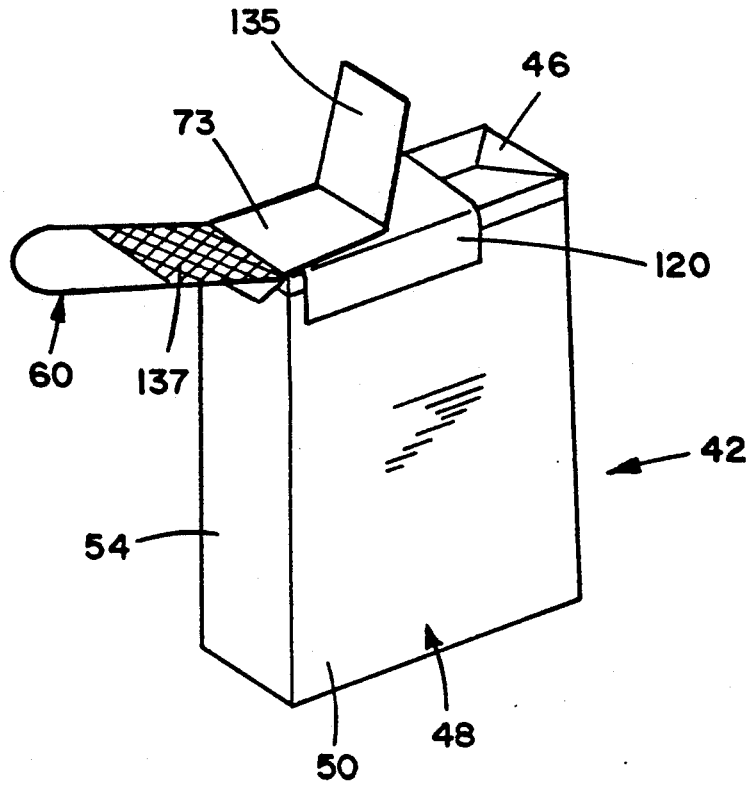
FIG. 10 is a perspective of a cigarette package having two closure tabs.

Referring to FIG. 10, there is shown a cigarette package essentially as shown in FIG. 8. However, the closure tab 120 is slit so as to provide movable flap 135. In the representative embodiment shown, movable flap 135 can be opened about a hinge formed in the center of the closure tab 120. The package also includes closure tab 60 of the type previously described with reference to FIG. 5. The movable flap 135 can be closed, and the closure tab can be adhered on top of the movable flap to re-close the package.

Figure 11:
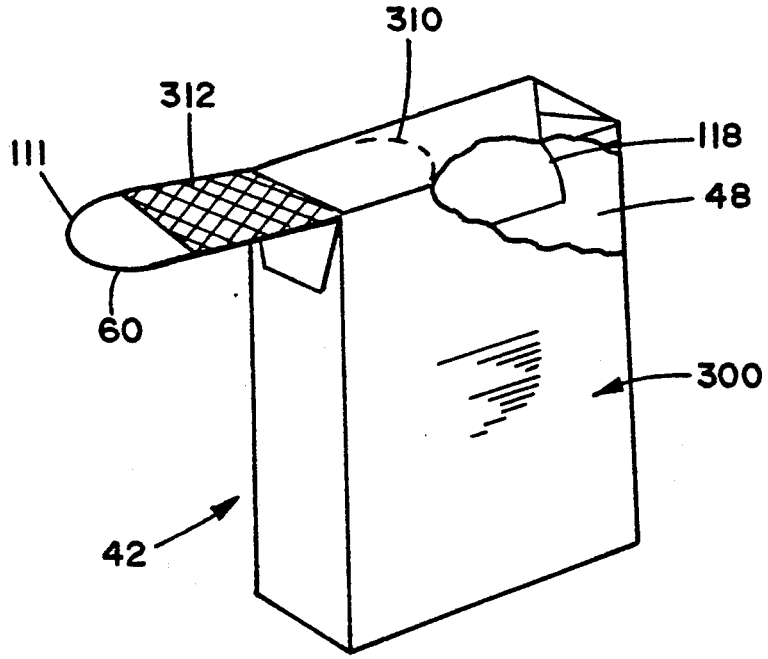
FIG. 11 is a perspective of a cigarette package having an outer sealing film and a closure member, the package being shown in a closed position with the closure member shown as not yet sealed to the sealing film at the top of the package.

Referring to FIG. 11, there is shown a cigarette package 42. The package includes a label wrap 48 which includes a bottom, and four side walls. The label wrap 48 is open at the top thereof, and is configured so as to contain cigarettes (not shown). The package does not include the inner metal foil/paper laminate wrap which is employed in the package previously shown with reference to FIGS. 1, 2, 5-8 and 10. A closure stamp 118, extends over the top central portion of the label wrap 48, and is adhered to the top region of the front and back walls of the label wrap. The closure stamp 118 normally is an aluminum coated polyester film (e.g., having a thickness of about 3 mils to about 3.5 mils), or like material. The package includes an outer sealing film 300, such as a metallized thermoplastic film. A representative sealing film is 80 gauge polyester film having a very thin film of vacuum metallized aluminum deposited thereon. The sealing film 300 is shown as partially cut away at the upper region of the package to expose the closure stamp and label wrap. The film has a weakened region 310, in the region thereof which overlies the closure stamp 118. Typically, the weakened region is provided as a perforation pattern which is cut (e.g., using mechanical cutting or laser techniques) into the sealing film during construction or assembly of the package. The closure stamp typically is of sufficient thickness to protect cigarettes in the package from damage when the weakened region is applied to the sealing film. Frequently, the perforation pattern has a "U" shape, having a plurality of very short, tight nicks or cuts towards the bottom of the "U", and a series of relatively long cuts along the sides of the "U", in order to assure the desired tearing of the sealing film when the package is opened. The sealing film does not include a tear tape, as is conventional for packaged cigarettes. The package also includes a closure tab of the type described with reference to FIG. 5. The closure tab is secured to the upper region of the side 54 of the package using an adhesive such as in available as V-23 Adhesive from Flexcon Company, Inc. The closure tab 60 has adhesive applied to the surface thereof in region 312 which contacts the top surface of the sealing film, particularly the weakened region 310. The closure tab is secured to the top of the package using an adhesive such as is available as V-22 Adhesive from Flexcon Company, Inc. The end 111 of the tab 60 can be free of adhesive in order to allow the tab to the grasped. The sealing film is sealed using techniques known in the art. The tab 60 then is pressed over the top of the package so as to provide a sealed package.

Figure 12:
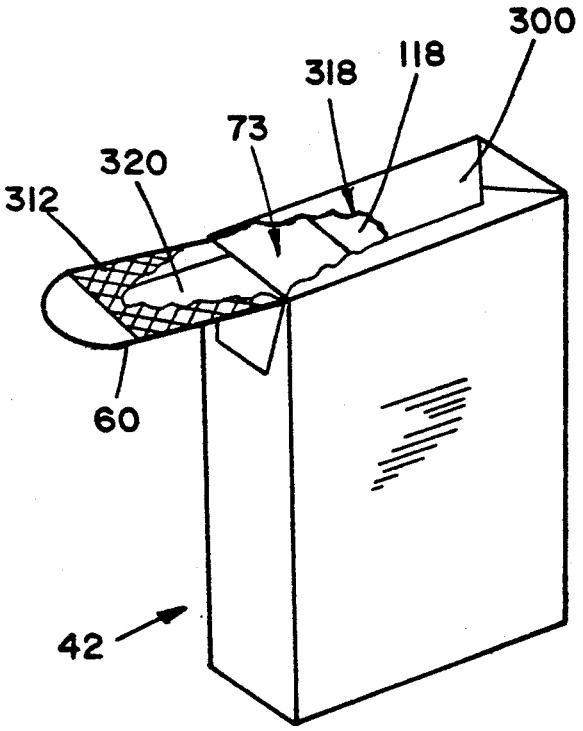
FIG. 12 is a perspective of the cigarette package of FIG. 11, the package being shown in an open position after the closure member which has been sealed to the top of the package has been pulled back from the top of the package.

Referring to FIG. 12, the package of FIG. 11 is opened by pulling the tab 60 back to the position shown. As a result, a portion 320 of the region of the sealing film which is adhesively secured to the closure tab is torn away in region 73 to open the package and expose cigarettes (not shown) within the package. The closure tab then can be torn from the package or be used to re-close the opened package. That is, adhesive 312 which remains exposed on the tab can be used to tack the tab shut. In a preferred situation, all of the sealing film remains in contact with the package, and no portion of the sealing film is removed from the package or the connected closure tab when the package is opened.

If desired, the package described with reference to FIGS. 11 and 12 can include a folded inner wrap, such as a metal foil/paper laminate, as is conventional for many soft package designs. Alternatively, that package can include only the folded metal foil/paper laminate inner wrap, rather than the label wrap (i.e., the inner wrap can be substituted for the label wrap). Preferably, neither the inner wrap nor the label wrap provide a top to the container, as (i) the outer sealing film and the closure tab provide an adequate top for the package, and (ii) cigarettes can be easily removed from the package once the package is opened.

Preferably, the label wrap and/or the optional folded inner wrap are designed to provide a bottom wall. As such, the ultimate package is provided with stability, especially once the package is opened. However, the bottom to that portion of the package is optional, particularly if an outer sealing film having adequate strength can integrity is employed. As such, the cigarettes can be simply banded in a circumscribing packaging material, and overwrapped with the previously described sealing film. In certain circumstances, the label wrap and/or inner wrap can have a thickness and integrity greater than those materials conventionally used for manufacturing soft packages (e.g., particularly when no top and bottom is provided); and as such, the ultimate package can be provided so as to have more of a crush proof character.

Figure 13:
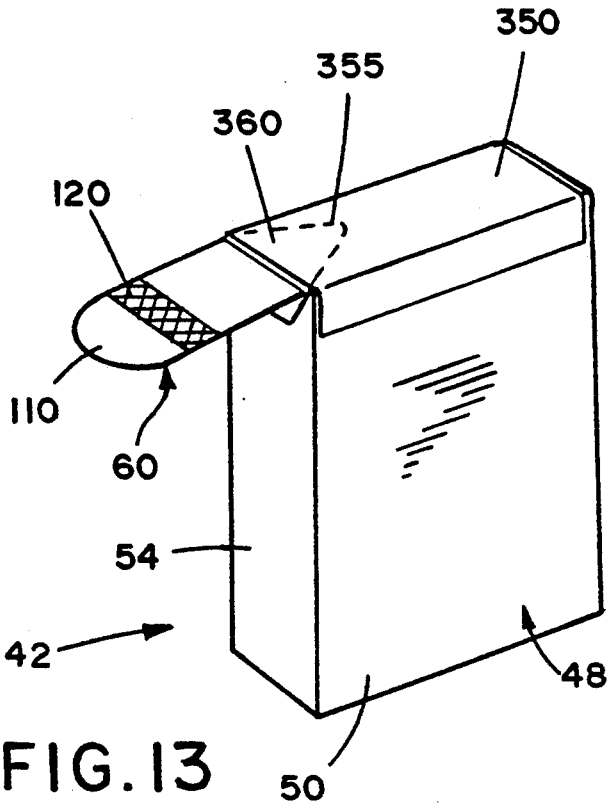
FIG. 13 is a perspective of a cigarette package having a large closure stamp and a closure tab.

Relating to FIG. 13, package 42 includes a label wrap 48 which contains cigarettes (not shown). Preferably, the package does not include the foil/paper laminate inner wrap referred to with reference to those package previously described with reference to FIGS. 1, 2, 5-8 and 10. However, such an inner wrap can be employed, if desired. The package most preferably is wrapped with an outer sealing film (not shown) equipped with a tear tape (not shown), as is conventional for soft cigarette packages. The package includes a large sealing tab 350 extending across the full top of the package and adhesively sealed to the top portions of the front and back walls of the label wrap 48. The sealing tab 350 includes a perforated line 355 defining removable portion 360. A closure tab 60, of the type previously described with reference to FIG. 6, is secured to the top region of one side of the package adjacent to the removable portion 360. As such, the closure tab can be sealed across the top of the package and opened. The removable portion 360 can be removed to expose cigarettes within the package. The closure tab then can be torn from the package or used to re-close the package.

Figure 14:
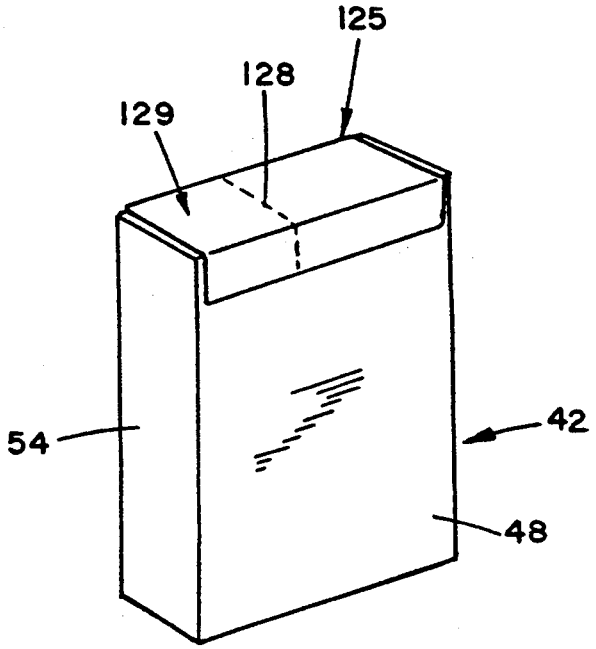
FIG. 14 is a perspective of a cigarette package having a large closure stamp.

Referring to FIG. 14, package 42 is generally similar to that package described with reference to FIG. 13. However, the package does not include a closure tab which is adhered to the top side of the package, and the closure stamp has the form of an enlarged closure tab 125 which extends across the top of the container. The enlarged closure tab 125 and use thereof is described previously with reference to FIGS. 8 and 9.

Figure 15:
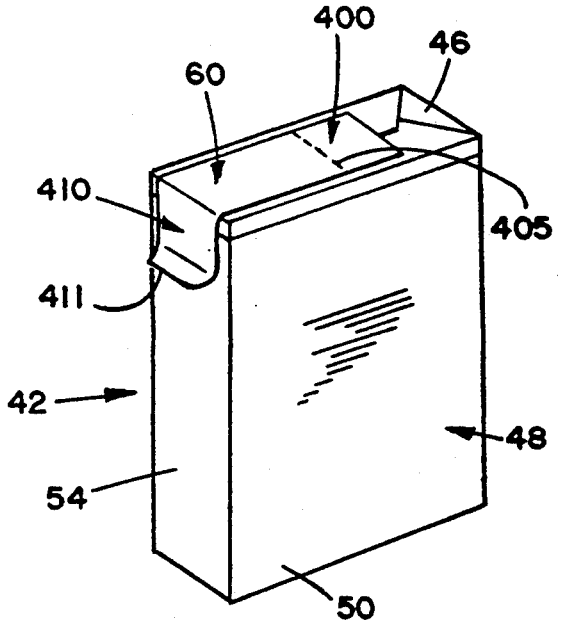
FIGS. 15 and 16 are perspectives of cigarette packages in closed positions.

Referring to FIG. 15, package 42 is generally similar to that package described with reference to FIG. 5. However, the closure tab 60 is rotated 180° relative to the package. As such, the closure tab is adhered to the top of the package at region 400 using permanent pressure sensitive adhesive, and opens and closes about the top of the package about hinge 405. Separable pressure sensitive adhesive is applied to the inner surface of closure tab at region 410 where the closure tab overlies the top side of the package. Thus, the closure tab is maintained in a sealed or shut position. End region 411 of the closure tab provides a region for the smoker to grasp.

Figure 16:
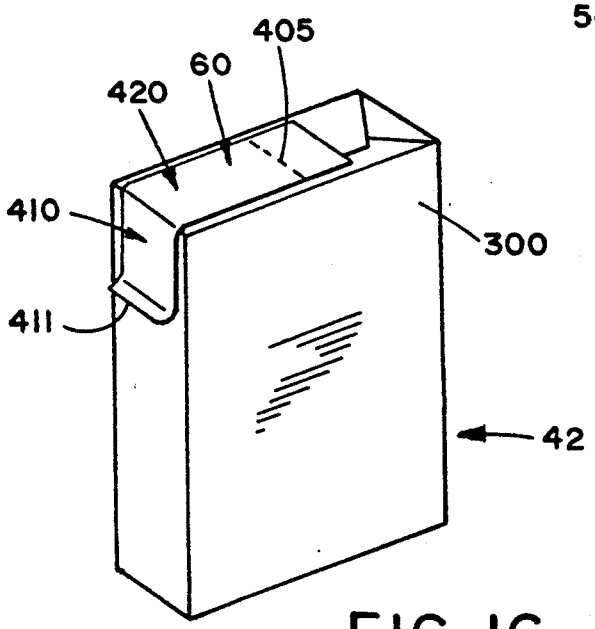

Referring to FIG. 16, package 42 is generally similar to that package described with reference to FIG. 11. However, the closure tab 60 is rotated 180° relative to the package. As such, the closure tab is adhered to the top of the package at region 400 using permanent pressure sensitive adhesive, and opens and closes about the top of the package about hinge 405. The weakened region (not shown) is positioned near the top side edge of the package in the sealing film underneath the closure tab 60 in region 420. Separable pressure sensitive adhesive is applied to the inner surface of the closure tab 60 at the region thereof which overlies the top side 410 of the package as well as weakened region, in order that the package can be opened and re-closed in generally the manner described with reference to FIGS. 11 and 12.

In a much less preferred embodiment (not shown), the packages described with reference to FIGS. 1, 2, 5–8, 10, 13, 14 and 16 can have the respective closure tabs positioned at the bottom of the respective packages, and the tear tapes of the respective packages can be positioned at the top of the respective packages. As such, packages can be opened from one end in the conventional manner, or from the opposite end using the tab of the present invention.

The closure tabs of the various embodiments of the present invention preferably are manufactured from materials such as metallized thermoplastic films. Exemplary metallized thermoplastic films have thicknesses of about 2 mils to about 4 mils, often about 2.5 mils to about 3.5 mils. A representative closure tab is a polyester film having a thin film of aluminum deposited thereon, the resulting aluminized film having a thickness of about 3 mils. Certain of the closure tabs can be applied to the package by the manufacturer, or the closure tabs can be supplied separate from the package and be applied to the package by the smoker. The closure tab can have indicia, graphics, couponing information, marketing information, directions, etc., printed thereon.

The closure tab allows an opened soft package to be closed and maintained shut. Under conditions of normal use, the soft package can be reopened and re-closed several times, and usually for the useful lifetime of the opened package. As the pressure sensitive adhesive has a tendency to bind the closure tab to the package, the opened package can be resealed to some degree and provide a desirable barrier to the atmosphere, moisture, and other foreign elements. As such, the opened package can be sealed in such a way so as to provide varying degrees of airtight capability to the re-closed package. Thus, the cigarettes within the opened package can experience reduced exposure to the atmosphere, and hence experience maintained freshness. The opened package also can be sealed in a way such that moisture has difficulty entering the opened package. Thus, the cigarettes within the opened package experience protection from foreign matter which has a propensity to diminish the quality of the cigarettes or otherwise be dissonant to the organoleptic characteristics associated with the cigarettes contained in that opened package.

The adhesive useful in securing the closure tab to the remainder of the package can vary. Typically, the adhesive is a pressure sensitive adhesive. Normally, the closure tab is adhered to the package using a permanent adhesive, while a separable adhesive can be used if desired. Normally the portion of the closure tab which is moved to open and close the package is a separable adhesive. The sealing properties of the adhesive are dependent upon factors such as the composition of the adhesive, and the composition and physical properties of the substrate to which the adhesive is applied. As used herein, the term "permanent adhesive" means an adhesive which secures two substrates (e.g., packaging material and closure tab) together; and upon an attempt to cause physical separation of each of those substrates, the adhesion of those substrates is sufficiently great that cohesive failure occurs (i.e., physical failure, such as tearing, of at least one substrate occurs). As used herein, the term "separable adhesive" means an adhesive which secures two substrates (e.g, packaging material and closure tab) together; and upon an attempt to cause physical separation of each of those substrates, the adhesion of those substrates is sufficiently poor or non-permanent that adhesive failure occurs (e.g., physical failure or distortion of each of the substrates does not occur to any significant degree, and the two substrates are separated from one another). A separable adhesive preferably is resealable, in that the adhesive remains sticky or tacky after two substrates which that adhesive secures together are separated from one another, and as such, that adhesive can once again adhesively secure those substrates together.

For purposes of the present invention, suitable separable adhesives for adhering an aluminized polyester film to either a paper label wrap or an 80 gauge aluminized polyester film have a tack of less than about 0.4 lb/in., preferably less than about 0.35 lb/in., measured according to Tappi Test Method T-540. Other suitable separable adhesives for adhering a metal foil/paper laminate to an aluminized polyester film have a tack of less than about 1 lb/in., preferably less than about 0.9 lb/in., measured according to Tappi Test Method T-540.

Suitable pressure sensitive adhesives include acrylic copolymers, polyester copolymers, polystyrene copolymers, polyurethane copolymers, ethylene vinyl acetate copolymers, and the like. See, Bernard S. Herman, *Adhesives Recent Developments,* Chapter 1, (1976).

What is claimed is:

1. A package containing cigarettes including an outer paper label wrap and an inner metal foil/paper laminate wrap, the package having top, bottom, front, back and two side walls, the package comprising a closure tab composed of a metallized thermoplastic material.

2. The package of claim 1 further including an outer sealing film.

3. A package having a top and containing cigarettes, the package including an inner container and an outer sealing film, the outer sealing film having a region of weakness in the top of the package, the package further including a closure tab composed of a metallized thermoplastic material, the closure tab adhered to the top of the package at least over the region of weakness.

4. The package of claim 2 or 3 wherein the outer sealing film is a metallized thermoplastic film.

5. A package having a top wall and two sides and containing cigarettes, the package including an inner container and an outer sealing film, the outer sealing film having a region of weakness in the top of the package, the package further including a closure tab adhered to the top wall of the package at least over the region of weakness, the closure tab also being adhered to one side of the package having a separable pressure sensitive adhesive in a region thereof which overlies a top wall of the package.

6. A package having a top wall and two sides and containing cigarettes, the package including an inner container and an outer sealing film, the outer sealing film having a region of weakness in the top of the package, the package further including a closure tab adhered to the top wall of the package at least over the region of weakness, the closure tab being a metallized thermoplastic film having a thickness of about 2 mils to about 4 mils and being adhered to one side of the package.

7. A package having a top wall and two sides and containing cigarettes, the package including an inner container and an outer sealing film, the outer sealing film having a region of weakness in the top of the package, the package further including a closure tab adhered to the top wall of the package at least over the region of weakness, the closure tab being adhered to one side of the package and a region which overlies a top side edge of the package, the closure tab is perforated in the region thereof which overlies the top side edge of the package.

* * * * *